US005394614A

United States Patent [19]

Lindner et al.

[11] Patent Number: 5,394,614

[45] Date of Patent: Mar. 7, 1995

[54] APPARATUS FOR CHECKING THE IN-REGISTER BEARING OF A PRINTING PLATE ON THE PLATE CYLINDER OF PRINTING MACHINES

[75] Inventors: Bernd Lindner, Heusenstamm; Helmut Schild, Steinbach/Taunus; Gunter Loch, Offenbach; Nicola Pupic, Heusenstamm, all of Germany

[73] Assignee: MAN Roland Druckmaschinen AG, Germany

[21] Appl. No.: 106,082

[22] Filed: Aug. 13, 1993

[30] Foreign Application Priority Data

Aug. 13, 1992 [DE] Germany ..... 42 26 780.3

[51] Int. Cl.[6] ..... B41B 11/00

[52] U.S. Cl. ..... 33/621; 101/415.1; 101/477; 101/DIG. 36

[58] Field of Search ..... 33/614, 617, 618, 621; 101/415.1, 481, 477, 378, DIG. 36

[56] References Cited

U.S. PATENT DOCUMENTS

| | | | |
|---|---|---|---|
| 3,154,012 | 10/1964 | Fischer | 101/415.1 |
| 3,160,096 | 12/1964 | Norton | 33/618 |
| 3,858,512 | 1/1975 | Simeth | 33/618 |
| 4,259,904 | 4/1981 | Mette | 33/618 |
| 4,603,641 | 8/1986 | Jeschke et al. | 101/415.1 |
| 5,052,120 | 10/1991 | Lubberts | 33/618 |
| 5,097,763 | 3/1993 | Simeth | 33/614 |
| 5,320,041 | 6/1994 | Maejima et al. | 33/621 |
| 5,322,014 | 6/1994 | Keller | 101/415.1 |

FOREIGN PATENT DOCUMENTS

| | | | |
|---|---|---|---|
| 69382 | 10/1969 | Germany . | |
| 3019595 | 11/1981 | Germany | 101/415.1 |
| 0075900 | 9/1985 | Germany . | |
| 3527103C2 | 11/1987 | Germany . | |
| 0195848B1 | 9/1990 | Germany . | |
| 3940795C2 | 9/1991 | Germany . | |
| 3940796C2 | 9/1991 | Germany . | |
| 62-221541 | 9/1987 | Japan . | |

*Primary Examiner*—Thomas B. Will

*Attorney, Agent, or Firm*—Leydig, Voit & Mayer, Ltd.

[57] ABSTRACT

An apparatus for checking the in-register bearing of a printing plate on the plate cylinder of printing machines possesses measuring sensors in the tension rail receiving the printing plate, by which the in-register position can be detected in the form of electrically scannable signals. Contact faces are mounted in the region of the tension rail so that the signals can be scanned directly by machine control, for example in conjunction with an automatic or manual printing-plate feed. The contact faces are placed in contact with the frame sensing heads which are mounted movably relative to the plate cylinder and which are pressed against the contact faces after an appropriate angular positioning of the plate cylinder. When a new printing plate is introduced, an evaluation unit receiving the signals is coupled to the measuring sensors.

19 Claims, 3 Drawing Sheets

APPARATUS FOR CHECKING THE IN-REGISTER BEARING OF A PRINTING PLATE ON THE PLATE CYLINDER OF PRINTING MACHINES

FIELD OF THE INVENTION

The present invention concerns printing machines and in particular apparatuses for checking the in-register bearing of a printing plate on the plate cylinder of printing machines.

BACKGROUND OF THE INVENTION

In sheet-fed offset printing machines, the printing plates for the differently colored part images are each mounted on a plate cylinder. Each printing plate is fastened (clamped) in a tension rail by means of an edge assigned to the print start and is then laid around the outer circumference of the cylinder. The printing plate's rear edge assigned to the print end is fastened in turn in a tension rail. Tensioning of the printing plate then takes place.

Since it is desirable for the prints to have a very high degree of accuracy of fit from the very outset in order to reduce waste, the front edge of individual printing plates must be introduced into the corresponding print-start tension rail very carefully. When a plate is inserted into the tension rails within the prescribed accuracy, the plate is referred to as being in-register. In order to achieve the prescribed level of accuracy, the printing plates often have, at the edge assigned to the print start, recesses in the form of punched-out portions which cooperate with corresponding locating pins in the tension rails. However, proper engagement between the recesses and the locating pins is obtained only when the respective printing-plate front edge has been brought to bear on such devices in an exact manner.

EP 0,075,900 B1 discloses an apparatus for checking the in-register clamping of printing plates having sensing pins arranged in the print-start tension rail. The in-register position of the printing plate is detected when the printing-plate edge contacts the sensing pins. This known device provides, in particular, an indicator which is arranged within the cylinder pit and means for adjusting the position of the printing plate in a controlled manner via an adjustable front tension rail.

EP 0,195,848 B1 discloses an apparatus which acts in a similar way. Blocks electrically insulated from the impression cylinder act as stop probes which cooperate with corresponding punchings in the printing plate. Light-emitting diodes integrated therein and a current supply which powers the diodes when the printing plate or the edge of the locating perforation comes into contact with the electrically insulated probes indicate whether the printing plate has been oriented in-register.

However, these previously known devices described briefly above are suitable only for manual drawing on of the printing plate since the operator must read off the respective corresponding optically transmitted signals directly in the cylinder pit or on the measuring sensors themselves while the printing plate is being introduced or while the printing plate is being oriented.

DD 69,382 PS discloses locating pins which are electrically insulated relative to the plate cylinder and which make an electrically closed contact when in contact with the printing plate or an edge of the printing plate. The closed electrical contact is sensed by the printing-machine control via a measurement transducer mounted on the rotatably mounted plate cylinder. Such a device can thus be used for an automated printing-plate feed. However, a disadvantage of this sensing apparatus is that a measurement transducer, consisting, for example, of a slip ring and current collector, has to be provided. This arrangement, however, introduces an additional source of possible machine failure.

DE 3,940,796 C2 discloses an apparatus for automatic changing of printing plates in which the above-mentioned measuring arrangement could be used. A printing plate is introduced from a storage chamber via transport rollers into a tension rail of a plate cylinder which has previously been moved into a specific angular position to receive the plate. A position detector, not specified in any more detail in this publication, detects whether the printing plate assumes a correct bearing within the tension rail assigned to the print start. If a proper position is indeed detected, the devices for closing the tension rail (clamps) are activated.

JP-A 62-22 1541 discloses as a printing-plate introduction aid for feeding printing plates into the print-start tension rail, in which a type of bearing table is placed against the correspondingly positioned plate cylinder. This bearing table has pivotable locating pins which cooperate with corresponding punched-out portions of the printing plate. When these are pivoted away and out of the conveying path of the printing plate, the pre-positioned printing plate falls into the opened print-start tension rail. However, according to this publication, an electrical scanning of the correct bearing of the printing plate within the rail is not provided.

SUMMARY OF THE INVENTION

In view of the shortcomings of the prior art, it is an object of the present invention to provide an apparatus for checking the in-register bearing of a printing plate in such a way that a position signal is available outside the plate cylinder without a high cost in terms of construction. The in-register position of a printing plate is to be detectable with a high degree of precision and accuracy.

According to the invention, tapping of the measuring sensor or measuring sensors takes place within the tension rail via sensing heads movably mounted on the frame relative to the plate cylinder. While the printing plate is being introduced into the tension rail, the sensing heads are pressed against contact faces located, for example, on the tension rail. The electrical signal of the measuring sensor or measuring sensors is not brushed out of the plate cylinder via measurement transducer. Instead, the signal is picked up by the apparatus during the operation of introducing the plate (the introduction of the plate being automatic or by hand).

The sensing heads are connected to an evaluation unit. The evaluation unit evaluates the signal tapped via the contact faces to determine whether the printing plate was properly positioned during introduction into the tension rail. If the plate was properly positioned, this condition is indicated optically and/or by a signal transmitted to a machine control. An example of such a machine control is an automatic clamping of the printing plate (motor acting on the plate cylinder from the frame or integrated in the plate cylinder).

In the simplest instance, the measuring sensors within the tension rail comprise locating pins mounted so that contact faces on the locating pins are partially or completely electrically insulated relative to the tension rail. The locating pins cooperate with corresponding punched-out portions on the front edge of the printing plate. Though the contact faces of the locating pins are electrically insulated completely or only partially relative to the plate cylinder in this embodiment, contact of an in-register printing-plate edge in the region of the punched-out portion creates a conductive connection (short-circuit) between the plate cylinder and the contact locating pin. After tapping the locating pin via the sensing head and contact face, the tapped signal is evaluated in an evaluation unit to verify a correct positioning of the printing plate within the tension rail.

In such a design using locating pins as measuring sensors, the contact face can be mounted directly on the end face of the locating pin which projects from the tension rail. It is also possible to adhesively bond special foils or the like to the tension rail itself in an electrically insulated manner which then form the contact faces. Of course, other suitable measuring sensors for the use of the apparatus according to the invention also come under consideration within the present invention. The measuring sensors can also be integrated in the tension rail and, for example, be designed as feelers or sensor means.

If a plurality of measuring sensors, especially locating pins, are arranged at a distance from one another in the tension rail in the axial direction of the plate cylinder, there are preferably provided a plurality of sensing heads. After a corresponding positioning of the plate cylinder has occurred (introduction of the printing plate), the sensing heads are pressed against the contact faces assigned to the measuring sensors. In an arrangement of this kind, each individual measuring sensor is scanned by an evaluation unit so that a conclusion can be drawn as to the location of the incorrect bearing. It is also possible, of course, to interlink the signals of the plurality of measuring sensors in the tension rail or in the plate cylinder by circuitry in the manner of a logical AND and thus only require one contact face on the tension rail to verify correct positioning of the printing plate. Accordingly, only one sensing head is necessary to tap this one contact face.

If the measuring sensors are locating pins, having contact faces insulated electrically relative to the plate cylinder when a printing plate is not in-register, and scanned by an evaluation unit for the purpose of detecting the correct position of the printing plate, then the measuring sensors are purely passive elements. There is no need for a current supply within the plate cylinder. However, if the measuring sensors are designed as active sensors or the like, a current supply for their operation would accordingly also have to be provided in the plate cylinder. A current supply could be provided for active sensors by means of corresponding sensing heads and contact faces, but also by means of a battery or accumulator provided in the plate cylinder, this being possible especially in respect to measuring sensors with low current consumption.

According to the invention, the sensing heads are mounted on the frame and movably relative to the plate cylinder. The sensing heads are placed against the corresponding contact faces in the region of the tension rail after a corresponding angular positioning of the plate cylinder. In one embodiment of the invention, the sensing head or heads are suspended in a linearly movable manner. According to a preferred embodiment of the invention, however, the sensing heads are suspended pivotably about a pivot axle extending parallel to the axis of the plate cylinder. In particular, the sensing heads are mounted on a guard displaceable movably in front of the printing unit and are pressed against the contact faces by means of an actuating means activated by compressed air.

If two locating pins are provided, the contact faces of the pins being electrical insulation relative to the tension rail and plate cylinder, and the two locating pins are connected to the evaluation unit via two sensing heads for signal evaluation, the sensing heads are mounted at the same axial distance from one another on a rail which is suspended parallel to the axis of the plate cylinder on a pivot axle. When inserting the printing plate, the rail together with the sensing heads is placed against the tension rail of the plate cylinder. It is highly advantageous to mount the sensing heads on a specially designed rail which extends over the format width of the plate cylinder. This allows the sensing heads to be placed against the outer circumference of the plate cylinder in the region of the print start in a way such that the front edge of the printing plate can be introduced into the opened gripping region of the tension rail via an introduction face of the rail facing the plate cylinder. A rail of this type provides a funnel-shaped enlargement of the opened gripping region of the tension rail. One face of the funnel is formed by the rail and the other face is formed by part of the outer circumference of the plate cylinder in the region of the print start. It is now possible to ascertain directly whether this printing plate bears correctly against the locating pins by placing the sensing heads, for example, against the electrically insulated contact faces of the locating pins while the printing plate is being inserted into the gripping region.

Adjustable stops can be provided on the rail. The stops are placed against the plate cylinder or directly on the sensing heads. The stops enable the sensing heads or the rail to be supported on the tension rail directly or on the plate cylinder (bearer ring) so that the force with which the sensing heads press against the contact faces is limited. In particular, the sensing heads are designed as tips which are pressed under spring force against the contact faces in a manner similar to that used for oscillographs. The sensing heads can thus be designed as a resilient contact or with electronic components for impedance-adjusted signal-voltage tapping.

It is highly advantageous when implementing the present invention to mount the sensing heads on a device which is placed against the plate cylinder in order to feed a printing plate either automatically or manually into the tension rail. In particular, this can be carried out on a printing-plate cassette mounted pivotably in a known manner relative to the plate cylinder.

BRIEF DESCRIPTION OF THE DRAWINGS

Furthermore, the explanation of a particular embodiment of the invention is made by means of the drawings. In these drawings.

While the invention will be described in connection with a particular embodiment, there is no intent to limit it to this embodiment. On the contrary, the intent is to cover all alternatives, modifications and equivalents included within the spirit and scope of the invention as defined by the appended claims.

DETAILED DESCRIPTION OF THE PREFERRED EMBODIMENTS

Figure 1:
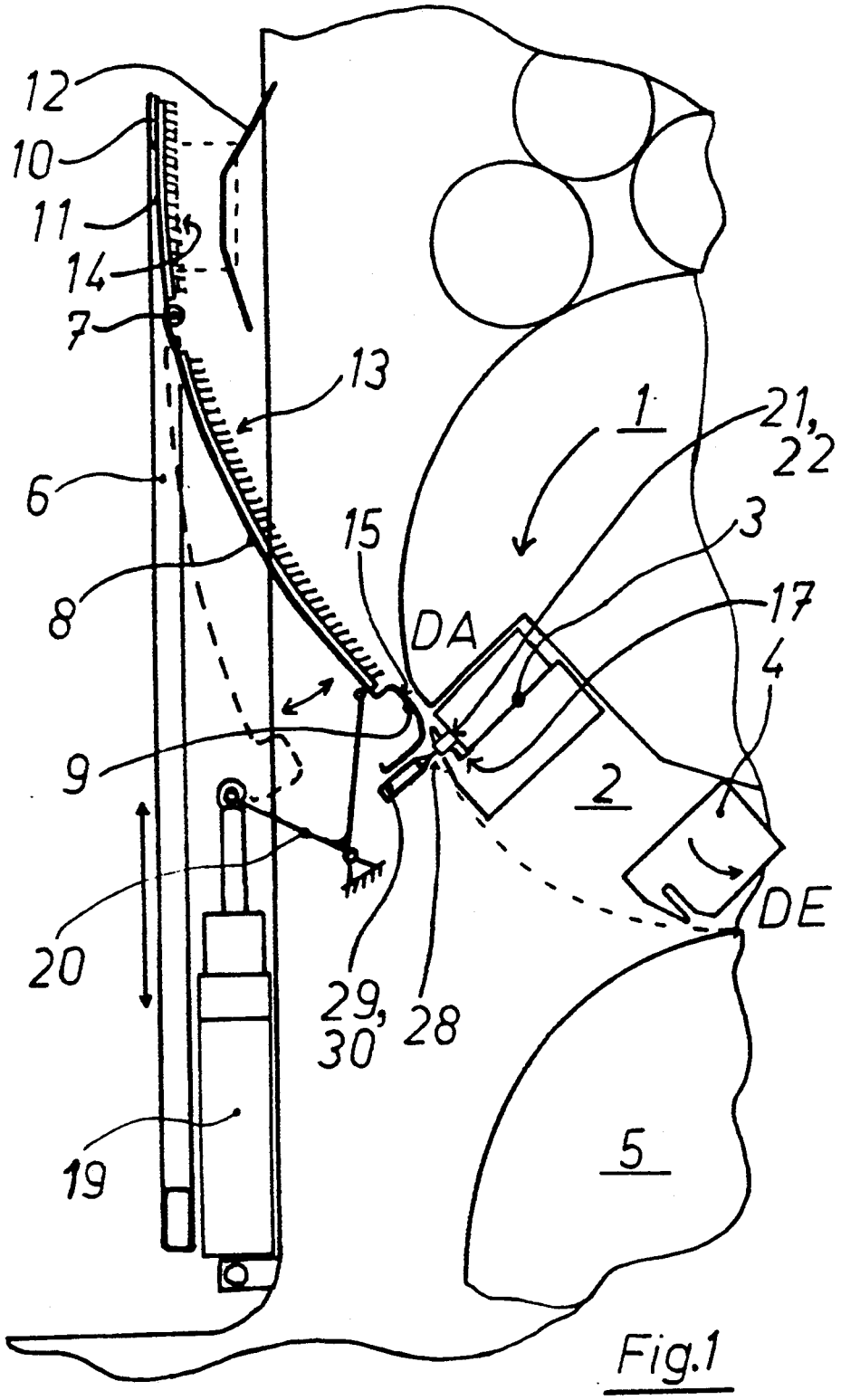
FIG. 1 shows a sectional view through a printing unit illustrating a preferred suspension of the sensing heads.

FIG. 1 shows, in sectional view, part of a printing unit of a sheet-fed printing machine of in-line design. Mounted between two side-frame walls of this printing unit is a plate cylinder 1 which includes a cylinder pit 2, tension rails 3 and 4 assigned respectively to the print start DA and to the print end DE.

A guard 6, which, according to FIG. 1, is in a basic position during the printing mode and is displaceably arranged in front of the printing unit having the plate cylinder 1 and a rubber-blanket cylinder 5 by means of a guide rail mounted on a side-frame wall of the printing unit (not shown). The guard 6 can be pushed up according to the arrow.

A pivot axle 7 is preferably mounted as a rotary joint in an upper part of the guard 6. A sheet-metal profile 8 is suspended on the pivot axle 7. The sheet-metal profile 8 has a slight curvature and exhibits the same format width as the plate cylinder 1. A rail 9 is mounted or produced by appropriate profiling on the free end of the sheet-metal profile 8. This rail 9 can be placed against the outer circumference of the plate cylinder 1 or rotated away from the cylinder 1 as shown in FIG. 1 by solid and broken lines. Furthermore, mounted on an upper crossmember 10 of the guard 6 is a guide plate 11 which extends down almost as far as the top edge of the sheet-metal profile 8. A guide plate 12 having two bent legs is likewise mounted opposite the guide plate 11 on the guard 6. Brushes 13 are attached in a plurality of rows to the concave inside surface of the sheet-metal profile for the careful transport of a printing plate to be fed. After the plate cylinder 1 has been brought to a proper angular position (see FIG. 1) and the sheet-metal profile 8 has been swung to the position shown in FIG. 1 causing the rail 9 to be placed against the plate cylinder 1, a new printing plate is introduced directly into the opened gripping region 17 of the front tension rail 3. Manual feeding of a printing plate takes place through the slot of the two guide plates 11 and 12. Brushes 14 can likewise be arranged on the guide plate 11. As a consequence of the sheet-metal profile 8 being placed against the plate cylinder 1, the side of the rail 9 facing the plate cylinder 1 provides an introduction face 15 which, in turn, provides a region of the gripping region 17 enlarged in a funnel-shaped manner. The brushes 13 in the sheet-metal profile 8 are set deeper and in a way such that the guide path of the printing plate over the brushes leads directly into the plane of the introduction face 15.

This especially advantageous manner of mounting the swing-to sensing heads guarantees that the guard 6 does not have to be pushed up in order to introduce a new printing plate and may remain in the position shown in FIG. 1. A pneumatic cylinder 19 (on one or both side-frame-walls of the printing unit) acts via an angle lever 20 together with take-up pins to pivot the sheet-metal profile 8, together with the rail 9, toward and away from the plate cylinder 1. The sheet-metal profile 8, together with the rail 9, is pivoted toward the plate cylinder 1 in order to introduce a new printing plate into the gripping region 17 of the tension rail 3. The sheet-metal profile 8 is pivoted away again as soon as the new printing plate is clamped, or fastened, in the tension rail 3. The securing of the new printing plate onto the plate cylinder 1 then begins as a result of a slow forward rotation of the plate cylinder 1 in the direction of the arrow drawn on the plate cylinder 1 in FIG. 1.

Figure 3:
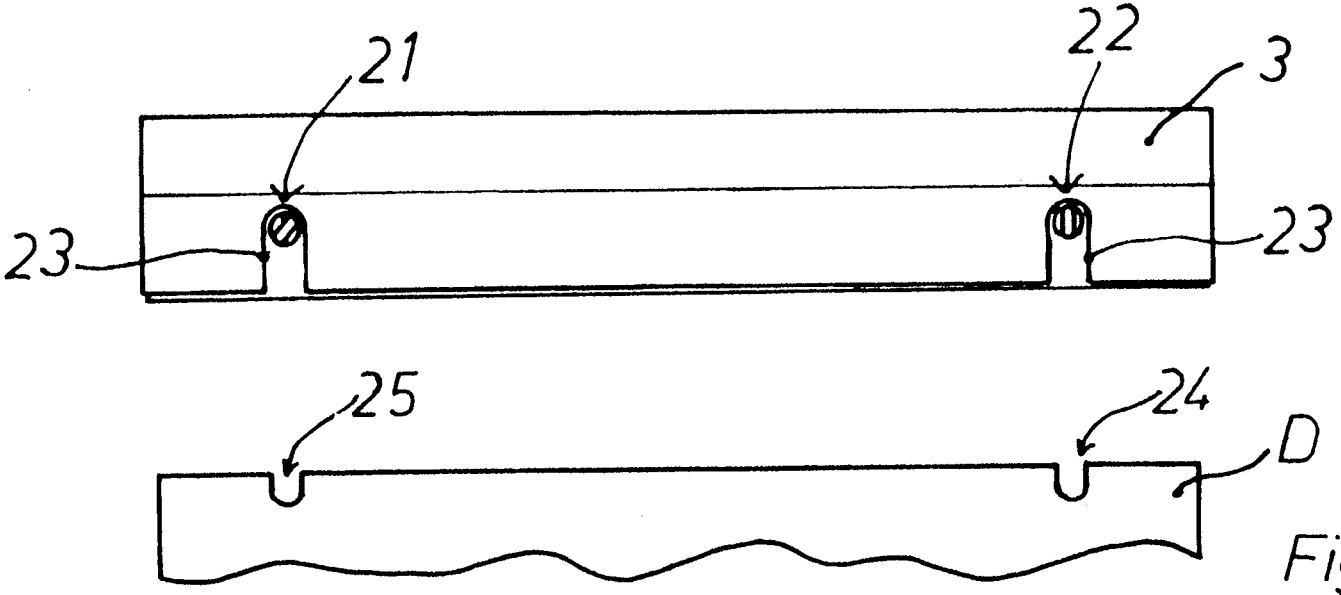
FIG. 3 shows a top view of the tension rail with the locating pins and contact faces according to the invention.

Two locating pins 21 and 22 are arranged in a known manner at an axial distance from one another in the tension rail 3 assigned to the print start DA shown in FIG. 1. FIG. 3 shows this arrangement of the locating pins 21 and 22 on the tension rail 3 in a view from above. According to FIG. 1 and FIG. 3, the locating pins 21 and 22 are mounted on a lower part of the tension rail 3 and extend through corresponding clearances 23 through the upper part of the tension rail 3 and are therefore accessible from outside the plate cylinder 1. In this version of a tension rail 3 selected merely as an example, the lower part is movable relative to the upper part and the gripping region 17 is closed as a result of the movement of the lower part relative to the upper part of the tension rail 3.

In addition, FIG. 3 illustrates the front edge of a printing plate D. Two punched-out portions 24 and 25 are made in the front edge of the printing plate D according to the shape of the locating pins 21 and 22, and their axial spacing coincides with the corresponding locating pins 21 and 22 when the printing plate D bears correctly in the tension rail 3.

Figure 4:
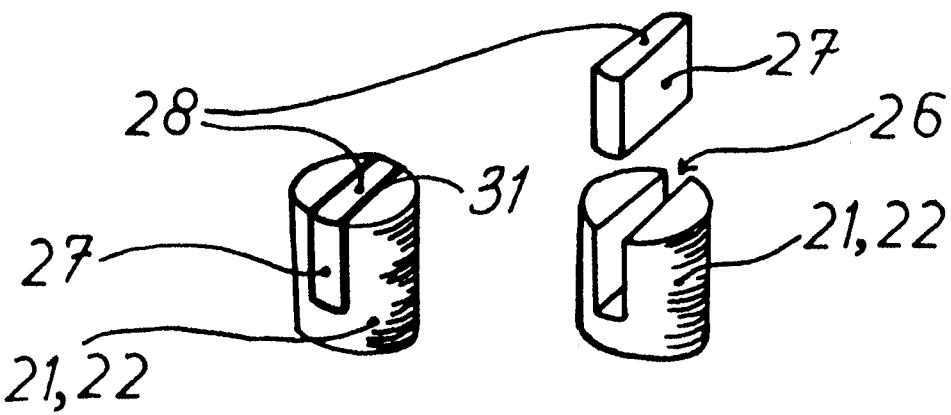
FIG. 4 shows a locating pin according to FIG. 3 in detail.

FIG. 4 shows locating pins 21 and 22 in detail. According to this embodiment of the locating pins 21 and 22, the locating pins 21 and 22 are made in two parts. One part of the locating pins 21 and 22 consists of the locating pins 21 and 22 with a slot 26 made in the end face. A filling piece 27 is inserted into the slot 26 as a second part in an electrically insulated manner well known to those of ordinary skill in the art. In the illustrated embodiment, the filling piece 27 is bonded into the slot 26 using an adhesive 31, which may be any of several known insulating adhesive materials. 0f course, other known methods of bonding the filling piece into the slot 26 can be utilized. The filling piece 27 completes the outer contour of the locating pins 21 and 22 disrupted by the slots 26. A face located on the front end of this filling piece 27 forms a contact face 28. According to the embodiment of the locating pins 21 and 22 shown in FIG. 4, the two locating pins 21 and 22 are formed on the tension rail 3 in the manner illustrated in FIG. 3. One locating pin 22 has a slot 26 extending in the circumferential direction of the plate cylinder 1 and one locating pin 21 has the slot 26 extending at an inclination of 45° relative to the circumferential direction of the plate cylinder. In-register bearing can be tested when the edges of the punched-out portions 24 and 25 of the printing plate D contact the locating pins 21 and 22 and the corresponding filling pieces 27. When the edges of the punched-out portions 24, 25 bear flush on the outer contour of the locating pins 21 and 22, the filling pieces 27 in each of the pins 21 and 22 are electrically connected to the locating pins 21 and 22, thus providing a conductive path from the contact faces 28 to the tension rail 3 via the locating pins 21 and 22. Since one slot 26 and therefore the corresponding filling piece 27 of one locating pin 21 extends at an inclination to the circumferential direction of the plate cylinder 1 as shown in FIG. 3, an error in the position of the printing plate D in the oblique or side-register direction can thus be detected.

Returning now to FIG. 1, two sensing heads 29 and 30 are mounted on the rail 9 of the sheet-metal profile 8 according to the axial spacing of the locating pins 21 and 22 and in the swung-to state of the rail 9 (pneumatic cylinder 19 activated) have tips pressed under spring force directly onto the contact faces 28 of the locating pins 21 and 22 as illustrated in FIG. 1. It can thus be ascertained in an evaluation unit (not shown) whether, as a result of the correct seating of the printing plate D, the filling pieces 27 are conductively connected to the locating pins 21 and 22. In this embodiment of the invention, it is possible to detect by means of the described short-circuit whether the potential of the filling pieces 27 has been reduced to the electrical potential of the plate cylinder 1.

In another embodiment of the invention, an electrical conductivity test can be conducted by recording a current flow by means of the sensing heads 29, 30. In a scan of this type, both direct current and alternating current can be used. By an appropriate setting of a threshold value in conjunction with adjustable sensitivities, a variation in conductivity of the filling pieces 27 relative to the locating pins 21 and 22 as a result of the influence of dampening medium or the like can also be taken into account in a known manner. Of course, the sensing heads 29 and 30 as well as their contacts are insulated electrically relative to the plate cylinder 1.

Figure 2:
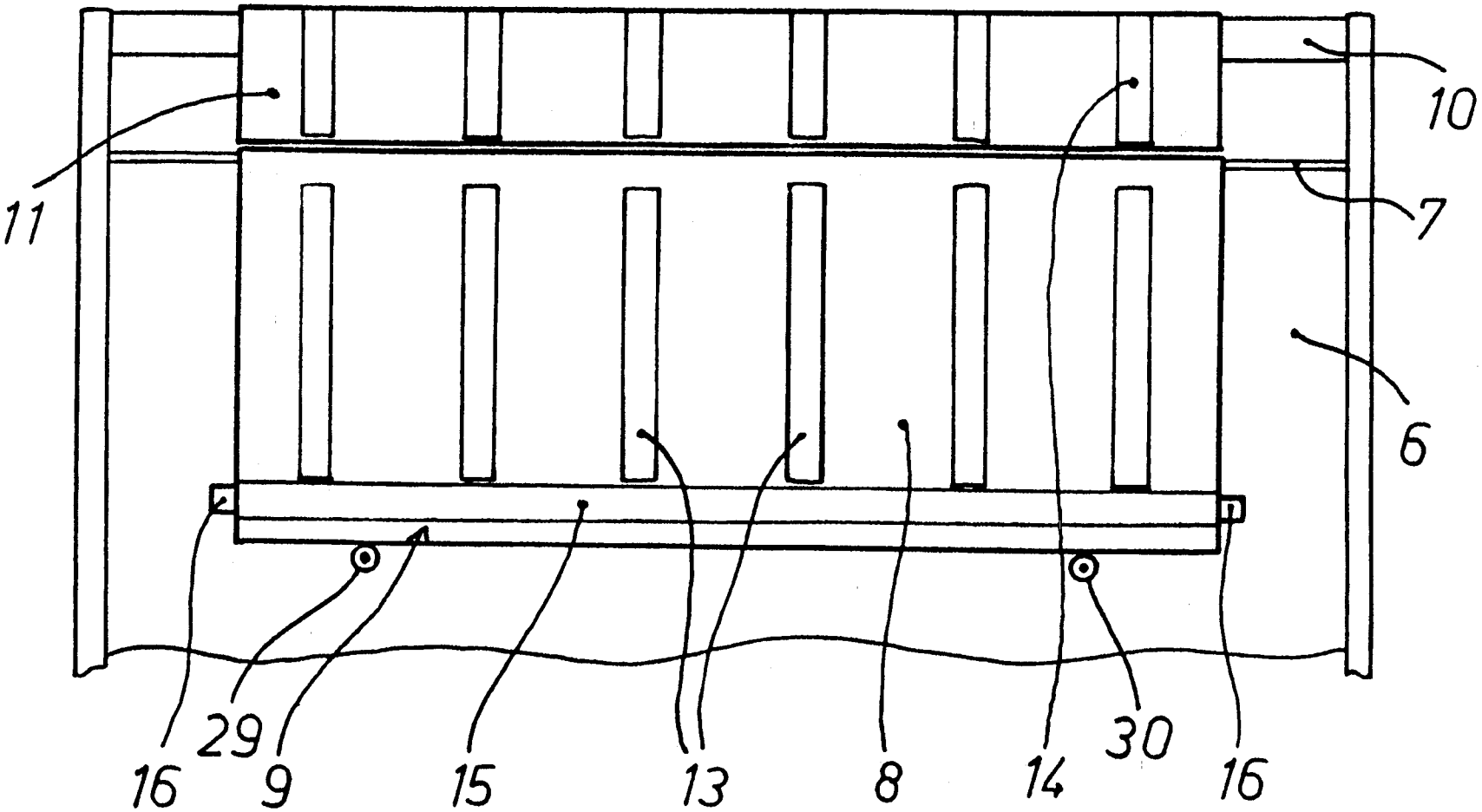
FIG. 2 shows a view of the suspension of the sensing heads according to FIG. 1 over the format width.

FIG. 2 shows a view from within the printing unit of the guard in front of the printing-unit cylinders 6 together with the sheet-metal profile 8 mounted thereon and the rail 9. Also shown are the guide plate 11 mounted on the crossmember 10 and the brushes 13 and 14 attached to the guide plate 11 and to the concave inside of the sheet-metal profile 8. The sheet-metal profile 8 and the rail 9 are mounted about a pivot axle 7 which extends between two frame parts of the guard 6. Mounted at the two ends of the rail 9 are two stops 16. The stops 16, in particular, are adjustable and in the embodiment shown in FIG. 2 press the rail 9 against the plate cylinder 1 so that a specific gap is obtained between the introduction face 15 and the print start DA on the plate cylinder 1 and also in order to avoid imposing excessively high pressure forces on the sensing heads 29 and 30 when the sensing heads are brought in contact with the contact faces 28. The stops may also be arranged in an alternative embodiment to press against the tension rail 3. In the embodiment shown in FIG. 2, the sensing heads 29 and 30 are mounted underneath the introduction face 15. As already indicated above, such a suspension of the sensing heads 29 and 30 on a rail 9 creating an introduction face 15 affords a highly advantageous method of scanning of the measuring sensors formed by the locating pins 21 and 22 as well as a very convenient method of introducing a new printing plate.

According to the embodiment of the invention shown in FIG. 1, the rail 9, together with the sheet-metal profile 8, remains placed against the plate cylinder until the printing plate is introduced into the gripping region 17 of the tension rail 3. This gripping region 17 is closed after a correct bearing of the printing plate is detected. The closing of the tension rail 3 or of the gripping region 17 takes place only when a correct bearing of the printing plate has been detected via the sensing heads 29 and 30 scanning the locating pins 21 and 22. When the printing plate is clamped, the rail 9 pivots back again into its position represented by broken lines in FIG. 1 and the printing plate is drawn onto the plate cylinder 1 completely.

What is claimed is:

1. An apparatus for checking the in-register bearing of a printing plate on a plate cylinder of a printing machine, especially a sheet-fed offset printing machine, the plate cylinder having a tension rail in a cylinder pit for receiving the printing plate edge assigned to the print start, said apparatus comprising:

a set of measuring sensors mounted upon the tension rail providing a detectable electrical signal when the printing plate assumes an in-register orientation relative to the tension rail, the set of measuring sensors including a set of contact faces mounted upon the measuring sensors for tapping the electrical signals of the set of measuring sensors; and one or more sensing heads suspended on a frame and mounted movably relative to the plate cylinder, the one or more sensing heads being positioned in accordance with the contact faces such that the one or more sensing heads are placed against the contact faces when the plate cylinder is moved into an angular position providing for the loading of the printing plate into the tension rail.

2. The apparatus of claim 1 wherein the set of measuring sensors are arranged in the tension rail at a distance from one another in the axial direction of the plate cylinder such that a one of the contact faces and a one of the sensing heads are provided for each one of the set of measuring sensors.

3. The apparatus of claim 1 wherein the set of measuring sensors comprise locating pins projecting from the tension rail, and wherein the contact faces are arranged at the ends of the locating pins and mounted so as to be electrically insulated from the tension rail.

4. The apparatus of claim 1 wherein the set of measuring sensors comprise locating pins projecting from the tension rail, and wherein the contact faces are arranged at the ends of the locating pins and mounted so as to be at least partially electrically insulated from the tension rail.

5. The apparatus of claim 3 wherein the locating pins in the tension rail comprise a first part and a second part arranged in a manner so that the first part is electrically insulated from the second part, the first part being connected to the tension rail and assuming the electrical potential of the plate cylinder, and the second part at the end of the locating pin providing the contact face for a one of the one or more sensing heads.

6. The apparatus of claim 5 wherein the first part of a one of the locating pins includes a slot in an end and the second part is inserted into the slot in an electrically insulated manner so that a punched-out portion of the printing plate makes an electrically conductive connection between the second part and the first part when the printing plate is in the in-register position.

7. The apparatus of claim 6 wherein at least two locating pins are arranged axially at a distance from one another in the tension rail, and a first locating pin includes a slot oriented in the circumferential direction of the plate cylinder and a second locating pin includes a slot oriented in a non-parallel direction relative to the circumferential direction of the plate cylinder.

8. The apparatus of claim 1 wherein the one or more sensing heads are suspended pivotally from a pivot axle oriented parallel to the axis of the plate cylinder.

9. The apparatus of claim 8, wherein the pivot axle is mounted on a guard, the guard being arranged in front of the printing-unit cylinders and wherein the guard is directed via a respective linear guide mounted on a side-frame wall of the printing unit.

10. The apparatus of claim 8 wherein the one or more sensing heads are mounted on a rail suspended pivotally on the pivot axle and extending in the direction parallel to the pivot axle, and wherein the rail is movable into a position proximate the plate cylinder.

11. The apparatus of claim 10 wherein the rail is movable into a position against the plate cylinder.

12. The apparatus of claim 10 wherein the rail is movable into a position against the tension rail.

13. The apparatus of claim 10 wherein the rail includes stops at both ends for supporting the rail by means of a set of bearer rings of the plate cylinder.

14. The apparatus of claim 10 wherein the rail extends over a format width of the plate cylinder, and wherein the rail is placed against the outer circumference of the plate cylinder in a region of a print start such that a front edge of a printing plate is introduced into an opened gripping region of the tension rail via an introduction face of the rail facing the plate cylinder.

15. The apparatus of claim 10 wherein the one or more sensing heads comprise at least two sensing heads mounted on the rail.

16. The apparatus of claim 1 wherein the one or more sensing heads are mounted on a device placed against the plate cylinder for introducing the printing plate into an opened gripping region of the tension rail.

17. The apparatus of claim 16 wherein the one or more sensing heads include tips pressed under spring force against the contact faces of the measuring sensors.

18. The apparatus of claim 17 further including a compressed air actuator for moving the one or more sensing heads into a contacting position with the contact faces.

19. The apparatus of claim 17 further including stops to limit the pressure of the one or more sensing heads upon the contact faces.

* * * * *